United States Patent [19]

Gold/dalg et al.

[11] Patent Number: 4,931,007

[45] Date of Patent: Jun. 5, 1990

[54] AUTOMATED CASTING APPARATUS

[75] Inventors: Joseph E. Gold/dalg, Zaragoza, Spain; Larry G. McKinney, Brownwood, Tex.

[73] Assignee: Kohler Co., Kohler, Wis.

[21] Appl. No.: 212,940

[22] Filed: Jun. 29, 1988

[51] Int. Cl.[5] ..... B28B 7/32; B28B 13/06

[52] U.S. Cl. ..... 425/438; 425/443; 425/451.7; 425/DIG. 112; 249/65; 249/66.1; 249/68; 249/166

[58] Field of Search ..... 425/438, 436 R, 443, 425/595, 451.7, DIG. 112; 249/66.1, 74, 65, 166, 68

[56] References Cited

U.S. PATENT DOCUMENTS

| | | | |
|---|---|---|---|
| 1,557,946 | 10/1925 | Smith | 249/166 |
| 2,298,223 | 10/1942 | Miller | 425/DIG. 112 |
| 3,156,008 | 11/1964 | Martin | 425/438 |
| 3,543,346 | 12/1970 | Breher | 425/595 |
| 3,570,064 | 3/1971 | De Groot | 425/438 |
| 3,570,068 | 3/1971 | Ruggles et al. | 425/438 |
| 3,915,613 | 10/1975 | Ruch | 425/438 |
| 4,179,254 | 12/1979 | Brown | 425/435 |
| 4,296,908 | 10/1981 | Lippa | 249/58 |
| 4,403,810 | 9/1983 | Bieneck | 425/589 |
| 4,570,897 | 2/1986 | Von Holdt | 249/144 |
| 4,614,325 | 9/1980 | Muldery et al. | 249/120 |
| 4,626,185 | 12/1986 | Mounet | 249/65 |
| 4,798,525 | 1/1989 | Sato et al. | 425/85 |

FOREIGN PATENT DOCUMENTS

| | | | |
|---|---|---|---|
| 887221 | 12/1981 | U.S.S.R. | 425/435 |

*Primary Examiner*—Jay H. Woo
*Assistant Examiner*—K. P. Nguyen
*Attorney, Agent, or Firm*—Quarles & Brady

[57] ABSTRACT

An apparatus for automated casting of an item such as a plumbing fixture is disclosed. Female and male mold portions provide the spacing for molding the desired item between them. A fluid activated release mechanism is operatively positioned on one of the mold portions so as to assist in separating the formed item from a mold portion in a controlled and uniform manner so as to minimize damage to the cast item. In a preferred manner, there is also a fluid activated holding mechanism for temporarily holding all of the mold portions together as well as an additional fluid activated mechanism to separate the mold halves. The apparatus and method herein described is especially well suited to multiple or battery-type casting operations.

12 Claims, 4 Drawing Sheets

AUTOMATED CASTING APPARATUS

BACKGROUND OF THE INVENTION

A. Field of the Invention

This invention relates to an apparatus and method for automating the process of casting articles. It appears to be especially well suited for use in automating the casting of several plumbing fixtures at the same time.

B. Description of the Art

It is known in the art to utilize a manually drivable "stripper" ring to assist in separating a molded part from a mold member. This is shown in U.S. Pat. No. 4,296,908. The art has also tried to automate the holding of mold parts together during casting using hydraulic driven clamps (e.g. U.S. Pat. No. 3,570,064) and to design machines capable of casting of several identical objects at the same time. However, improvement is still needed in automating the casting process, especially with respect to plumbing fixtures and the like where extremely fragile castings must be removed from the mold.

In this regard, manually drivable stripper rings are time consuming to use, and may damage the contact surface of the molded product. They do not provide sufficient control over the amount of pressure the fragile casting edges are exposed to. Existing systems are also deficient in the areas of automating the process of separating the mold halves. If not properly done, the fragile molded part can be damaged during this process aside from the excessive time required to undo multiple manual clamps and to manually separate mold halves. Thus, an improved molding apparatus and method are needed.

SUMMARY OF THE INVENTION

The present invention therefore relates to machines and methods for casting desired items in molds and to improved means of separating mold parts and the casted piece from the mold parts. In a preferred embodiment, there is an apparatus which includes a female mold portion and a male mold portion for spaced positioning in the female mold portion such that a desired item can be formed therebetween. A release means (e.g. in the form of a stripper ring) is positioned on one of the mold portions. Fluid means is operatively connected to the release means for moving the release means to assist in separating the formed item from a mold portion.

In another embodiment, there are holding means including additional fluid means for clamping the mold portions together, and yet another fluid means positioned between the mold portions for separating them.

In still another embodiment, there is provided a method of casting a desired item. One places a release ring on a first mold portion; positions the first mold portion with the release ring thereon in a spaced relationship with respect to a second mold portion; casts the desired item between said first and second mold portion; and then separates the cast desired item from one of the mold portions by applying a fluid force on the release ring.

The apparatus and method of the invention further improve the automation of multiple casting of items (e.g. ceramic toilet tanks).

The objects of the invention include:

providing a automated method and apparatus for removing a fragile cast part from a mold member without damaging the part;

providing a method and apparatus for the multiple casting of ceramic materials which lends itself to a high production mode and is adaptable to current casting procedures;

providing a method and apparatus where a single pneumatic system can facilitate clamping, separation of the mold parts, and separation of the cast part from a mold part; and providing a highly efficient method and process of the above kind for producing cast materials.

These and other objects and advantages of the present invention will be apparent from the description which follows.

This description below is provided by way of illustrating preferred embodiments of the present invention, not to limit the claim scope. Thus, the claims are not to be limited to just the embodiments shown.

DESCRIPTION OF THE DRAWINGS

A better understanding of the invention will be had with reference to the accompanying drawings.

DESCRIPTION OF THE PREFERRED EMBODIMENTS

Figure 1:
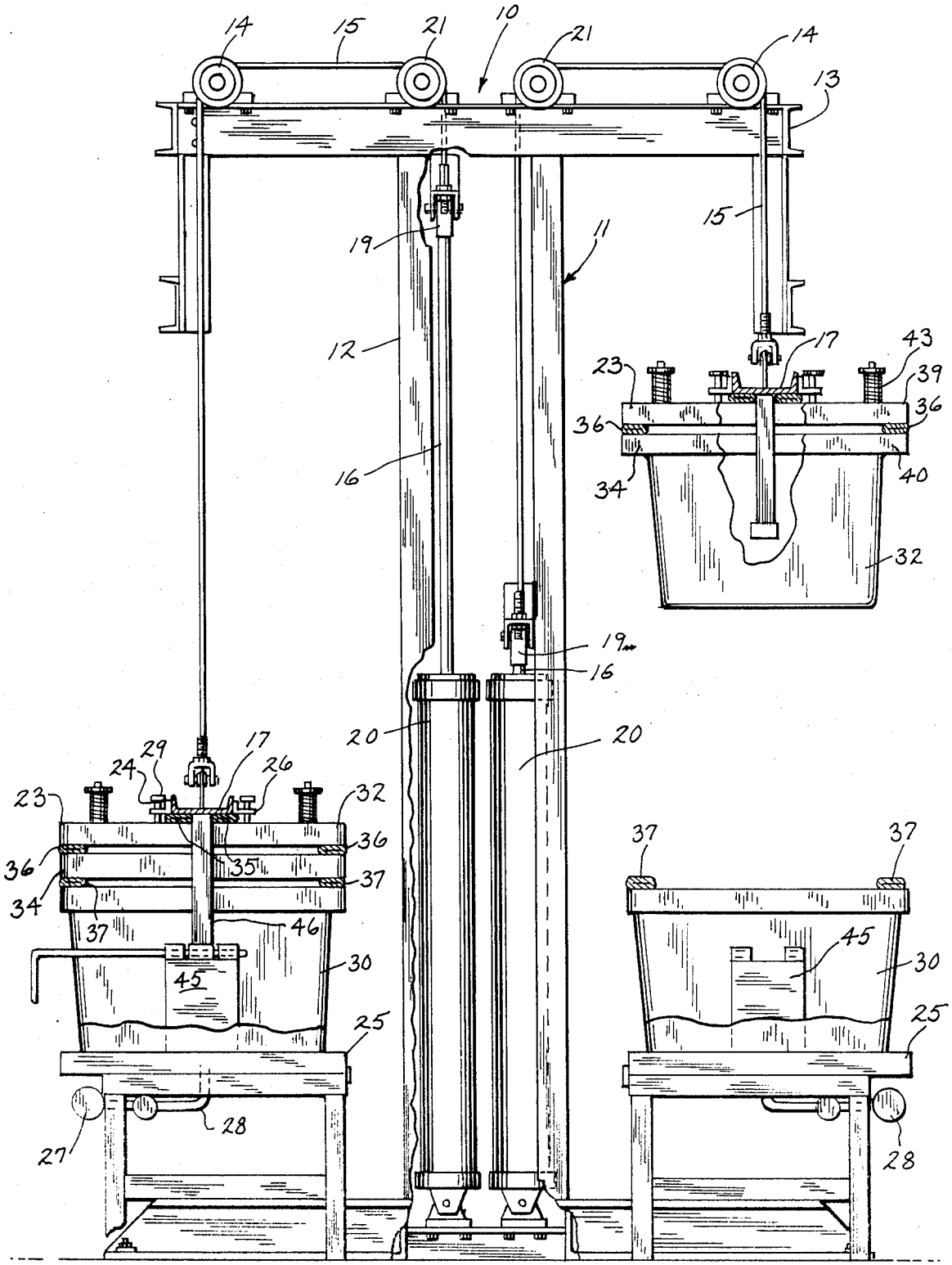
FIG. 1 is an end elevational view showing the apparatus of this invention in two different stages of operation.
Figure 2:
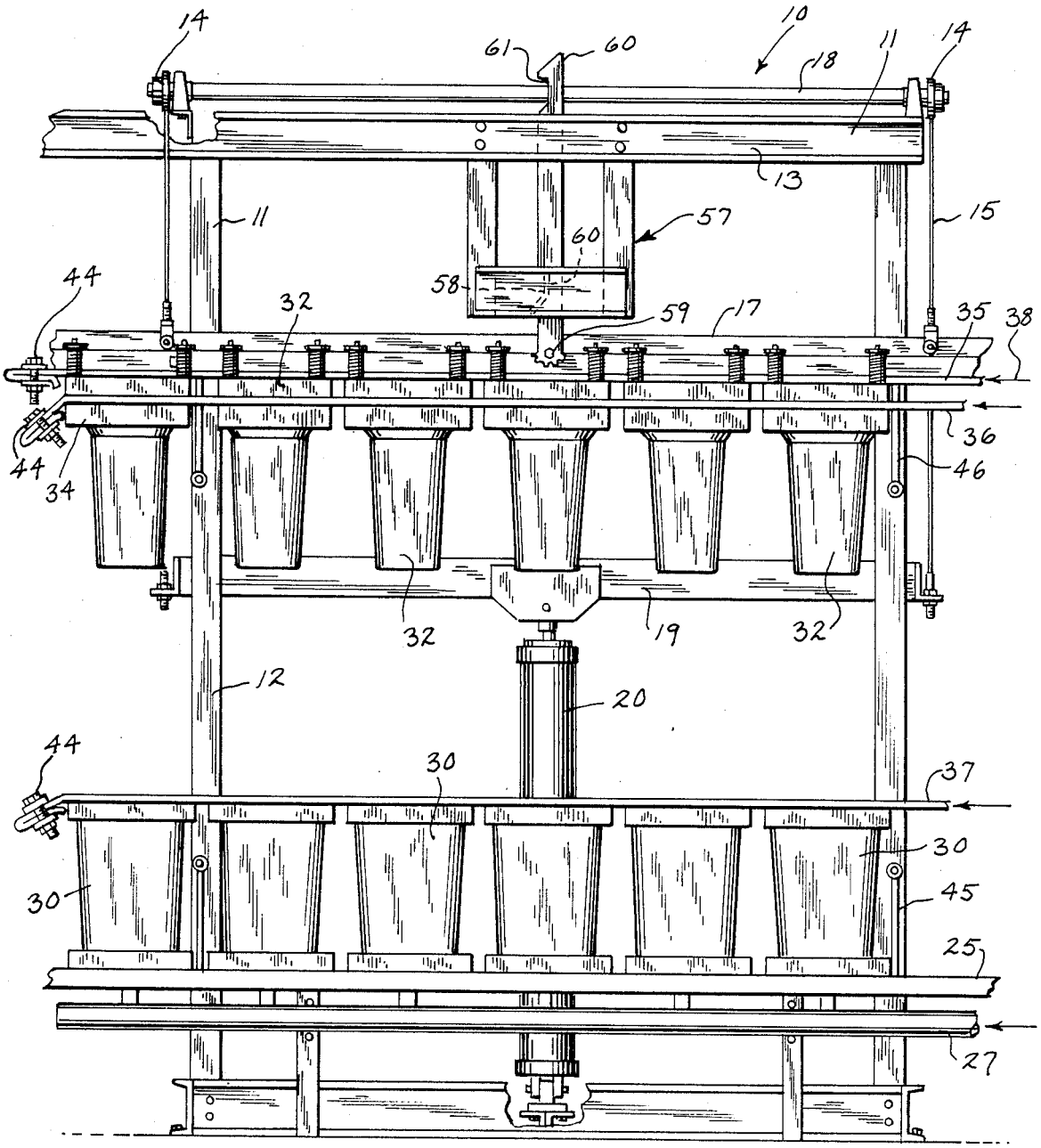
FIG. 2 is a front elevational view of the apparatus shown in FIG. 1.

The overall casting apparatus (generally 10) is best seen in FIGS. 1 and 2. It includes a frame assembly 11 that runs from end to end, hydraulic cylinders 20 for raising and lowering the upper portion 23 of the production line. The frame assembly 11 includes vertical 12 and horizontal 13 supports with the horizontal supports 13 providing rotatable support for the chain guide sprockets 14 and 21. A chain 15 engages the sprockets 14 and 21 and is connected at one end to an end to end beam 17, and at the other end to the cylinder rods 16 of the cylinders 20. This latter connection is provided through the beam 19 as best seen in FIG. 1. These cylinders 20 through the previously described connection with the chain 15 will raise and lower the upper portions 23.

Figure 3:
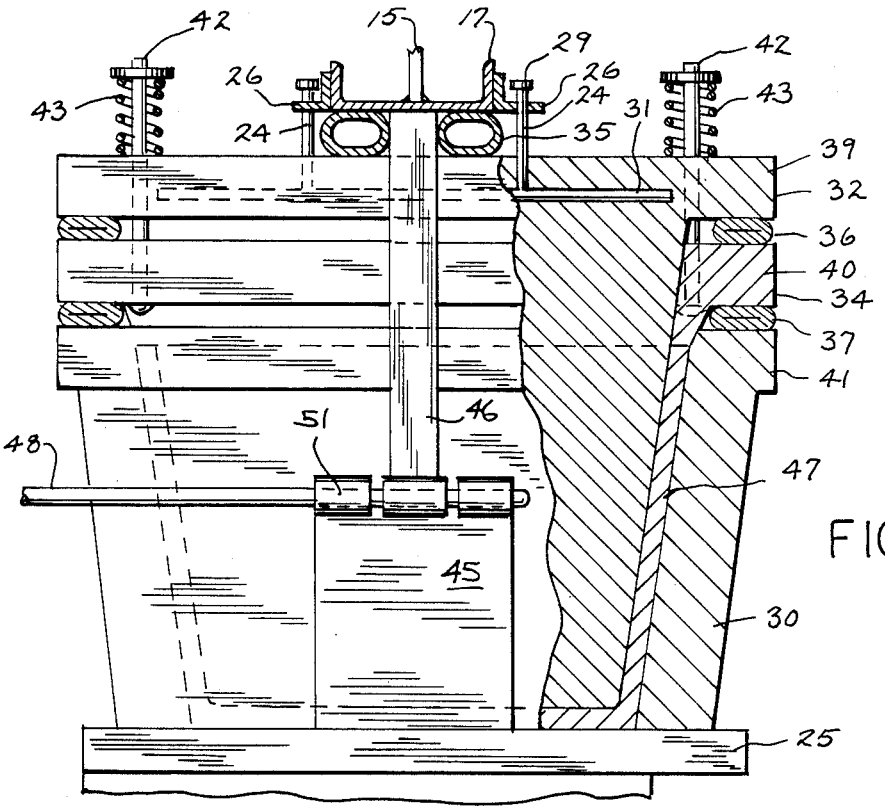
FIG. 3 is an enlarged detailed view of a portion of the left hand side of FIG. 1, with a portion broken away, illustrating the mold parts in a clamped position, in the casting mode.
Figure 4:
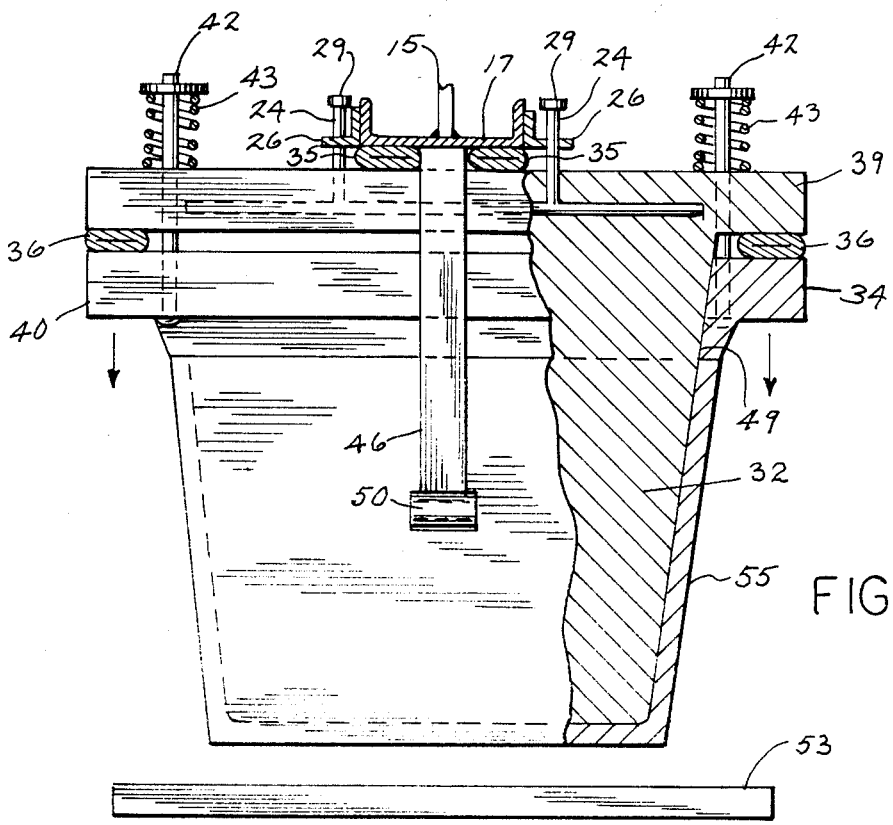
FIG. 4 is a view similar to FIG. 3 but showing the molding apparatus in a final stage of operation and prior to the release of the molded part.

FIGS. 1 and 2 disclose female mold portions 30, mold male portions 32 and release or stripper rings 34. As shown in FIG. 1, the male mold portions 32 are connected to the beam 17 by rods 24 which are slidably received in the flanges 26 of beam 17. Suitable openings are provided in the flanges 26 for this purpose and the enlarged rod heads 29 provide retention. The rods 24 are secured in the male mold portion 32 by the horizontal portion 31. This is best seen in FIGS. 3 and 4.

Positioned between the male mold portions 32 and the beam 17 are a pair of end to end hoses 35. Placed between the male mold portions 32 and the release rings 34 are also a pair of end to end hoses 36. Further, placed between the release ring 34 and the female mold portion 30 are a pair of end to end hoses 37. As best seen in FIG. 3, the hoses 36 are positioned between the flanges 39 and 40 of the respective male mold portions 32 and the release rings 34, and hoses 37 are placed between the flanges 40 of the release rings 34 and the flanges 41 of the female mold portions 30.

Referring back to FIG. 1, it is seen that there are two end to end benches 25 which support the female mold portions 30 and extend down each of the back to back production lines. These benches also provide a means for supporting the casting intake manifold 27 and the lateral casting lines 28. These provide a path for the casting material to the inside of each female mold portion 30. Also connected to the benches 25 are the clamp plates 45 which provide a connection with the clamp arms 46 connected to the beams 17. Referring again to FIGS. 3 and 4, it is seen that the clamp arm 46 has the eye portion 50 and the clamp plate 45 has the eye portions 51. These provide for alignment and reception of the pin 48 for connecting the clamp plate 45 and the clamp arm 46 together. Also as best seen in FIGS. 3 and 4, the release ring 34 is connected to the male mold portion 32 in a biased manner through the pins 42 which extend through the flange portion 39 of the male mold portion and adjacent the flange portion 40 of the release ring 34. Expansion springs 43 are suitably retained over the top of the male mold portion 32 so as to afford the biasing of the flange portions 39 and 40 together.

Figure 5:
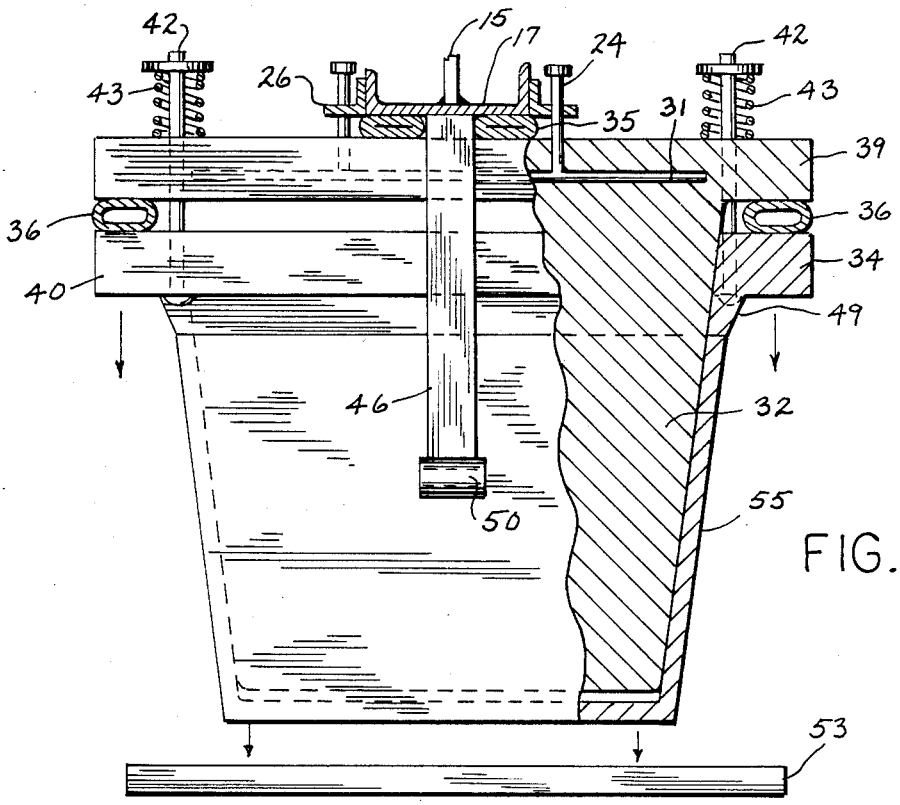
FIGS. 5 and 6 are views similar to FIG. 4 but showing the release of the molded part from the mold.
Figure 6:
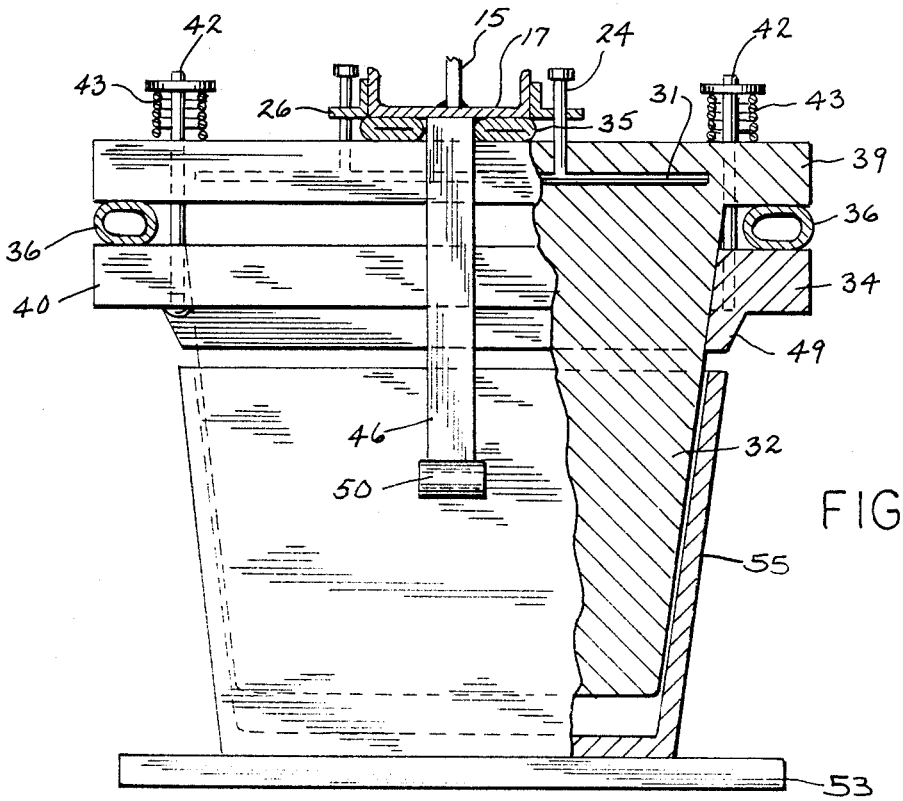

Referring specifically to FIG. 2, it is seen that there is a latch mechanism generally 57 which has a latch bar 58 for engagement with the relieved portions 61 and 62 of the latch bar 60. The latch bar in this instance is pivotally connected to the beam 17 such as indicated at 59. This does not form part of the invention but is merely a safety mechanism in the instance where a failure of the cylinders 20 might occur when the male mold portions 32 are in a fully lifted position such as shown in FIG. 2 or a partially lifted position as shown in FIGS. 4–6.

METHOD OF OPERATION

A better understanding of the apparatus 10 and its method of usage will be had by a description of its operation. As will be appreciated from FIGS. 1 and 2, the apparatus 10 is capable of a multiple or battery-type casting operation with a multiplicity of male 32 and female 30 mold portions positioned in a series as well as in two separate back to back rows. In a preferred manner eleven pairs of the mold portions are connected in series which means each casting apparatus 10 can cast 22 articles during one operation. Multiples of the apparatus 10 can also be used. This provides for maximum utilization of time, materials and conservation of space.

The process is started with the male 32 and female 30 mold portions positioned as shown at the left-hand side of FIG. 1. In this instance, the female mold portion 30 and the male mold portion 32 are clamped together by the clamp plate 45 and the clamp arm 46 with the pin 48 interconnecting them. In order to effect a complete clamping of these mold parts, the hoses 35 are inflated with a fluid such as air. This forces the mold portions 30 and 32 firmly together between the bench 25 and the beam 17.

The source of air is a common air regulated source and the introduction is indicated by the arrow 38 in FIG. 2. The hoses 36 and 37 are similarly inflated when desired. All of the hoses are clamped shut at the opposing end such as by the hose clamps 44. As indicated above, the mold portions are positioned as shown on the left side of the drawing FIG. 1 and in FIG. 3 with the female mold portion 30 resting on the bench 25. In casting a typical toilet tank, ceramic casting material of the usual type is introduced into the manifold 27. The casting material flows in a regulated manner through the casting line 28 and into the female mold part 30. This can be effected either by a gravity flow tank or by pump pressure using a control valve. The casting in the mold portions is best seen as shown in FIG. 3. Note that the male mold portion 32 is spaced from the female mold portion 30 a predetermined amount and will be filled with the casting material 47.

After a predetermined period of time which is standard for this type of casting, the male mold portion and the female mold portion 32 and 30, respectively, are separated from each other. This is accomplished by deflating the air hoses 35 by opening a release-valve (not shown), releasing the end to end pin 48, and inflating the air hoses 37. This latter inflation effects a movement between the female mold portion 30 and the release ring 34 which causes movement of the release ring and the male mold portion upwardly from the female mold portion 30. After this initial separation, a cylinder 20 will be actuated so as to lift the male mold portion 32 and the release ring 36 away from the female mold portion 30 with the resulting toilet tank 55 cast on the male mold portion 32. The lifting is to a height so that a suitable end to end support board to such as 53 (or multiple support boards) can be placed over the female mold portion 30. This is indicated in FIG. 4 with the male mold portion 32 and the tank 55 positioned a short distance over the board 53.

Another aspect of the invention is now described in the manner by which the casted tank 55 is stripped from the male mold portion 32. It should be appreciated that the casted tank 55 is of a very fragile material and consequently can be easily broken, cracked or warped if it is not removed from the male mold portion 32 with a uniform gentle force. This is the purpose of the hoses 36 and the biasing of the release ring 34 on the male mold portion 32. As the hoses 36 are inflated they effect a gentle, increasing pressure to cause a downward movement of the release ring 34 and its driving portion 49 against the top of the casted tank 55. This is best seen in FIG. 5. The fluid pressure is slowly introduced into the hoses so that the casted tank is slowly and carefully pushed off of the male mold portion 32 until it will slide onto the support 53. (See FIG. 6) Release ring 34 returns to its initial position with the release of pressure in the hoses 36 by the urging of the spring 43.

After the tank 55 is removed from the male mold portion 32 and deposited on the board 53, the assembly 23 is raised to a clear position such as that shown in the right hand side of FIG. 1. This allows for subsequent work to be easily effected on the newly casted tank 55.

Other fluid means besides pneumatic means could also be utilized to separate the male and female mold parts as well as to clamp the mold parts together. The hoses such as 36 provide fluid means for releasing the cast molded part 55. While air is the preferred fluid media water could be utilized (as could other gases or liquids). This also applies to the clamp and release hoses 35 and 36 respectively.

While the method and apparatus of this invention has been shown in conjunction with the casting of a plumbing fixture such as a toilet tank, it could also be employed to automate the cast of any type of molded part. Also, while an efficient casting method has been presented in the use of a multiplicity of mold assemblies which are grouped together in a battery-type operation, at least some of the advantages of this invention could be accomplished while employing it in a single mold.

While providing a pneumatic release means for releasing a mold part in conjunction with the male mold part is shown, it is also conceivable that the stripper be utilized in conjunction with the female molded part where the molded part is designed to initially adhere to the female mold portion. In this instance, the release means might be a bottom plate.

Thus, while certain preferred embodiments have been described above, it should be readily apparent to those skilled that a number of other modifications and changes can be made without departing from the invention. Therefore, it is intended that the scope of the invention should not be limited solely by the description of the preferred embodiments.

We claim:

1. An apparatus for casting a desired item, comprising:

a female mold portion;

a male mold portion for spaced positioning in said female mold portion such that the desired item can be formed therebetween;

release means operatively positioned between said mold portions for releasing the formed desired item;

a holding means including a first fluid means for clamping said female and male mold portions together during a portion of the casting of the desired item;

a first inflatable means operatively positioned and supported between said female mold portion and said release means for separating said female mold portion from said release means; and a second inflatable means operatively positioned between said release means and said male mold portion for driving said release means against the formed desired item to assist said release means in separating the formed desired item from said male mold portion.

2. The apparatus of claim 1 wherein said first and second inflatable means are defined by tubes.

3. The apparatus of claim 1 wherein said holding means includes a clamp member defined by first and second interengaging locking elements, said first interengaging locking element connected to a supporting frame for said female mold and said second interengaging locking element connected to said male mold portion and a pin for insertion into said locking elements.

4. The apparatus of claim 1 wherein said release means is defined by a stripper ring.

5. The apparatus of claim 4 wherein said stripper ring is attached to said male mold portion.

6. The apparatus of claim 5 further including biasing means to bias said stripper ring toward said male mold portion and against the force of said second inflatable means.

7. The apparatus as defined in claim 1 including means to lift said male mold portion and said release means from said female mold portion.

8. The apparatus as defined in claim 7 wherein said lift means includes a pneumatic cylinder means connected to a linking member for connection to a supporting beam for said male mold portion.

9. The apparatus as defined in claim 1, wherein said female and male mold portions are constructed and arranged to form a plumbing fixture.

10. The apparatus as defined in claim 1, wherein there are a multiplicity of interconnected female and male mold portions.

11. The apparatus of claim 5 wherein said attachment between said stripper ring and said male mold portion is provided by complementary flange portions on said male mold portion and said stripper ring, with biased guide pins extending through said flange portions.

12. An apparatus for casting a desired item, comprising:

a female mold portion;

a male mold portion for spaced positioning in said female mold portion such that the desired item can be formed therebetween;

release means operatively positioned between said mold portions for releasing the formed desired item;

a holding means including a first inflatable tubular means for clamping said female and male mold portions together during a portion of the casting of the desired item;

a second inflatable tubular means operatively positioned and supported between said female mold portion and said release means for separating said female mold portion from said release means; and a third inflatable tubular means operatively positioned between said release means and said male mold portion for driving said release means against the formed desired item to assist in separating the formed desired item from said male mold portion.

* * * * *